United States Patent [19]

McCall

[11] 4,332,005

[45] May 25, 1982

[54] LIGHTING PANEL FOR DROP CEILINGS

[75] Inventor: Francis L. McCall, Hacienda Heights, Calif.

[73] Assignee: Specified Ceiling Systems, Alhambra, Calif.

[21] Appl. No.: 133,607

[22] Filed: Mar. 24, 1980

[51] Int. Cl.[3] ..... F21S 1/02

[52] U.S. Cl. ..... 362/150; 362/311; 362/355; 362/374; 362/375; 52/28

[58] Field of Search ..... 52/28; 362/311, 355, 362/374, 150, 375

[56] References Cited

U.S. PATENT DOCUMENTS

| | | | |
|---|---|---|---|
| 3,019,333 | 1/1962 | Pascucci | 362/355 |
| 3,192,381 | 6/1965 | Zurawski et al. | 362/355 |
| 3,358,138 | 12/1967 | Trantina | 362/355 |
| 3,380,770 | 4/1968 | Risley | 362/355 |
| 4,060,025 | 11/1977 | Pelosi | 52/28 |

*Primary Examiner*—Stephen J. Lechert, Jr.
*Attorney, Agent, or Firm*—Christie, Parker & Hale

[57] ABSTRACT

There is described a lighting panel for a drop ceiling of the type in which a plurality of T-frame members are arranged in a grid, forming a pattern of rectangular openings with ceiling panels supported in the openings by the grid. The lighting panel has an outer frame which is slightly smaller than one of the openings, with a light diffusing panel mounted in the frame. The frame is supported from the grid frame members by a pair of support members that project from the outer frame at opposite ends of one side, the projecting support members allowing the one edge of the outer frame to be supported with the panel in a vertical position. The panel is rotated up into a horizontal position within the grid opening and latch means secures the free edge of the outer frame to the grid frame member to hold the lighting panel in place.

4 Claims, 6 Drawing Figures

LIGHTING PANEL FOR DROP CEILINGS

FIELD OF THE INVENTION

This invention relates to lighting panels for drop ceilings, and more particularly, to a panel which is pivotally supported on the drop ceiling framework.

BACKGROUND OF THE INVENTION

Drop ceilings for commercial and industrial buildings are well known. The drop ceiling is generally constructed of a metal framework of T-shaped members hung from the structural ceiling and forming a grid having a plurality of rectangular openings. The grid supports acoustical tiles or the like in the openings to form the drop ceiling surface. To provide overhead lighting in combination with drop ceiling construction, it has been the practice in the past to mount fluorescent lighting fixtures in the space above the drop ceiling frame and to provide a translucent panel flush with the drop ceiling below the fixture for diffusing light into the room.

In the past, the light diffusing panel has been supported in one of two ways to provide access to the light fixture for replacing bulbs from below. In one arrangement, the plastic light diffuser panel is supported directly on the drop ceiling framework. The light fixture, in the form of an open hood, is supported on the drop ceiling framework above the panel. This arrangement is relatively inexpensive, but removal of the light diffusing panel from below is cumbersome and time-consuming. This type of construction is not favored by the engineers and maintenance personnel. The alternative arrangement has been to construct the light diffuser panel and the light fixture as a unit with the light diffuser panel being mounted in a frame which is secured by hinges directly to the reflector hood of the light fixture. While this hinge arrangement simplifies the maintenance, the cost of the light fixture is substantially increased and more difficult and costly to install.

SUMMARY OF THE INVENTION

The present invention is directed to an improved light panel construction in which the light diffuser panel is directly supported from the drop ceiling framework independently of the light fixture, thus providing the relatively low cost and ease of installation normally associated with this type of installation. However, the present invention permits the light diffuser panel to be pivotally supported on the drop ceiling framework so that one edge of the panel can be lowered. The panel then is supported in a vertical position from the ceiling to permit access to the lighting fixture to replace bulbs or for cleaning without completely removing the panel. Thus the present invention avoids the burdensome and time-consuming task of lifting the panel and maneuvering it so as to lower it through the opening beneath the light fixture, as has been required in the past.

This and other advantages of the present invention are achieved by providing a light panel having an outer rectangular metal frame which is slightly smaller than the opening in the drop ceiling grid. Support members projecting outwardly from either side of the frame of the panel rest on top of the ceiling frame and pivotally support the panel beneath the ceiling. The free edge of the frame can be rotated upwardly on the support members to bring the panel into a horizontal position within the opening in the ceiling grid. A slidable latch allows the panel frame to be releasably secured to the ceiling frame to hold the panel in place.

BRIEF DESCRIPTION OF THE DRAWINGS

For a better understanding of the invention, reference should be made to the accompanying drawings, wherein.

DETAILED DESCRIPTION

Figure 1:
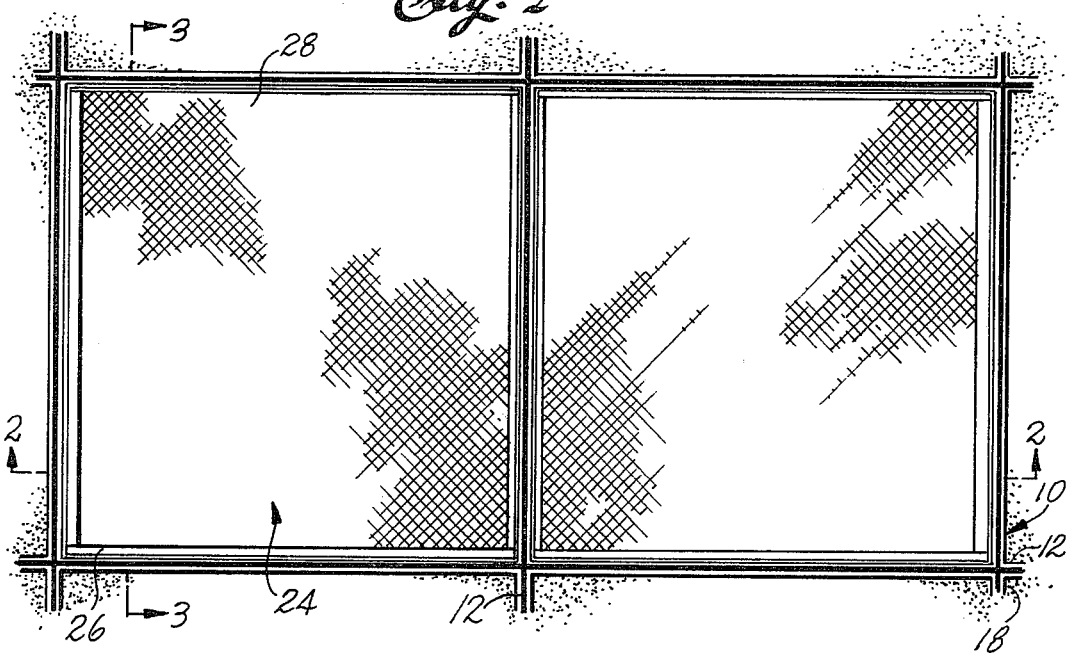
FIG. 1 is a plan view of a drop ceiling with lighting panels.
Figure 2:
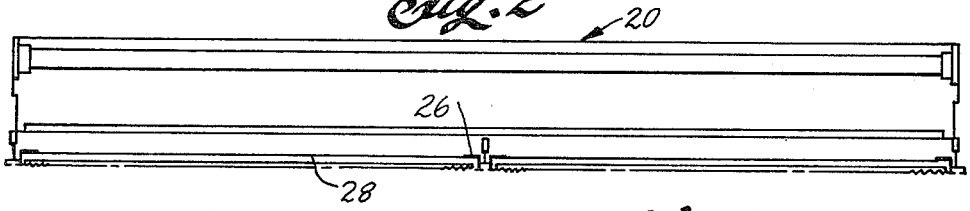
FIG. 2 is a sectional view taken substantially on the line 2—2 of FIG. 1.
Figure 3:
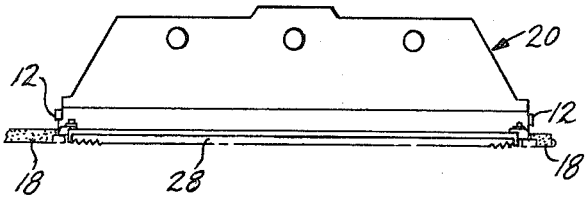
FIG. 3 is a sectional view taken substantially on the line 3—3 of FIG. 1.

Referring to the drawings in detail, the numeral 10 indicates generally a metal framework of a drop ceiling. The framework is generally constructed of T-shaped structural members 12 with parallel longitudinal runners being joined by cross runners to form generally square openings in the frame grid. The T-shaped frame members 12 preferably are of a construction described in U.S. Pat. No. 4,021,986. The frame members, however, can be of any suitable construction which includes a vertical web section 14 and horizontal support surfaces 16 on which acoustical ceiling tiles, indicated generally at 18, are supported.

To provide lighting, a fluorescent lighting fixture 20 is mounted on top of the grid 10 and supported thereon. The lighting fixture is in the form of a hood being generally rectangular in shape, the long dimension bridging two openings in the grid 10. Lighting fixture 20 is supported on the frame grid 10 by suitable clips which clip on to the frame members 12 and engage the lower edge of the lighting fixture 20. Such open hood type fluorescent lighting fixtures are relatively inexpensive standard items.

The present invention is directed to an improved arrangement for mounting a light diffusing panel, indicated at 24 in the drawings, in the grid openings below the lighting fixture 20. The lighting panel 24 includes an outer rectangular metal frame 26 constructed of four channel-shaped members joined at the corners with the channels opening inwardly. A standard translucent prismatic plastic panel 28 or the like is mounted in the frame 26. The outer perimeter of the frame 26 is shaped to fit into any of the square openings in the grid. Sponge rubber strips or other suitable compressable material secured to the outer edge of the frame 26 provides a light-type seal between the frame of the lighting panel and the surrounding ceiling grid frame members 12, as indicated at 30. Because the frame is smaller than the opening, the lighting panel assembly can be easily inserted into an opening in the grid from the room below the ceiling.

Figure 4:
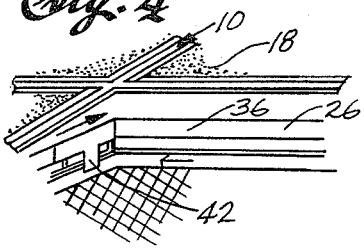
FIG. 4 is a sectional view enlarged.
Figure 5:
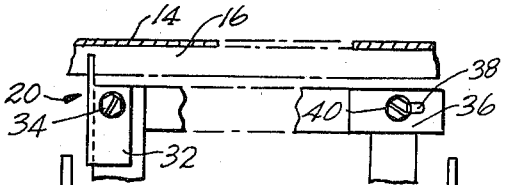
FIG. 5 is a partial top view.
Figure 6:
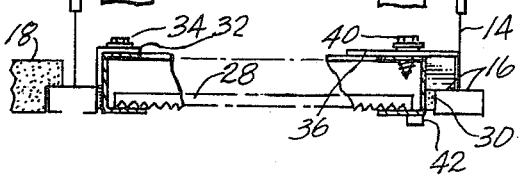
FIG. 6 is a partial perspective view showing the operation of the removable lighting panel.

The lighting panel 24 is supported by the ceiling grid framework 10 by a pair of support members 32 secured to the top of the frame 26 at two of the adjacent corners, as shown in FIGS. 4 and 5. The support members 32 are L-shaped so as to fit against the top and side of the frame 26. A sheet metal screw 34 may be used to secure the support members in place. One end of each of the support members 34 projects beyond the edge of the frame 26 by a sufficient amount so as to overlap and rest on top of the horizontal surfaces 16 of the T-shaped frame member 12 on either side of the grid opening. Thus the support members 32 provide pivots projecting from the opposite sides of the frame 26 along the same side of the frame. The support members 32 allow the panel 24 to be rotated from a vertical position in which the panel hangs from the supports 32 downwardly into the room, into the closed horizontal position in which the panel is flush with the rest of the ceiling.

To hold the lighting panel in the horizontal position, a pair of latch members 36 are slidably mounted at the other two corners of the panel frame 26. The latch members 36 are also L-shaped to fit snugly against the top and side of the frame. The top surface of the latch members includes a slot 38 through which a screw 40 passes to secure the latch members in place. The screw 40 preferably has a shoulder which fits into the slot 38 and spaces the head of the screw so that the latch member 36 slides freely between an open and closed position. In the closed position, shown by the dotted line in FIG. 5, the latch member extends outward from the frame 26 in position to rest on the surface 16 of the adjacent frame member of the ceiling grid 10. In this position the latch members and support members combine to support all four corners of the lighting panel in an opening in the ceiling grid. The latch member 36 has a tab 42 which projects slightly below the bottom of the frame 26, allowing the latch member to be moved manually into position after the lighting panel is rotated up into the horizontal position within the grid opening.

From the above description it will be seen that the lighting panels can be easily installed or removed after the ceiling is installed to provide access to the associated lighting fixture. The panel can be swung downwardly into a vertical position without completely removing the panel merely by releasing the latches 36 using the tabs 42, allowing the panel to pivot on the support members 32. The support members 32 continue to support the full weight of the panels in the open position. The panels can be completely removed merely by rotating the open panel so that the edge is aligned with a diagonal of the opening, in which position the support members 32 are no longer in engagement with the frame grid members.

What is claimed is:

1. A drop ceiling lighting apparatus comprising:

a plurality of parallel longitudinal drop ceiling frame members, spaced parallel cross frame members extending between the longitudinal members to form a grid having square openings, a pair of removable panels positioned in adjacent ones of said openings, each of the removable panels including a square panel frame of the same shape but slightly smaller on each side than the grid opening into which the panel fits, a sheet of translucent material mounted on the panel frame, a pair of support members projecting outwardly of the panel frame from opposite ends of one side of the panel frame for pivotally engaging a pair of adjacent parallel frame members at opposite sides of the square opening, the support members supporting the panel frame from the parallel grid forming frame members along one side of the panel while allowing the panel to rotate between a vertical open position and a horizontal closed position within the grid opening, latch means releasably securing each of the panel frames to the grid forming frame members when the panel frames are in the horizontal closed position, and a light fixture supported directly on the frame members above the panels and spanning both openings, the projected area of the light fixture being substantially different in shape and size than one opening in the ceiling grid.

2. Apparatus of claim 1 further including gasket means around the margin of the frame to form a light seal when the frame is positioned within the opening of the grid.

3. Apparatus of claim 1 wherein the latch means includes a pair of latch members slidably mounted on the panel frame adjacent the opposite corners from the support members, the latch members sliding between a retracted position and an extended position, the latch members in the extended position engaging the adjacent ceiling members to hold the panel in the horizontal position within the grid opening.

4. Apparatus of claim 3 further including a light fixture positioned above an opening in the grid, means supporting the light fixture on the grid, the said sheet of material being translucent to pass diffused light from the fixture through the panel into the room.

* * * * *